United States Patent [19]

Hoshiba et al.

[11] Patent Number: 5,018,503

[45] Date of Patent: May 28, 1991

[54] FUEL INCREASING SYSTEM FOR ENGINE

[75] Inventors: Akihiko Hoshiba; Kyoji Hakamata, both of Hamamatsu, Japan

[73] Assignee: Sanshin Kogyo Kabushiki Kaisha, Hamamatsu, Japan

[21] Appl. No.: 450,584

[22] Filed: Dec. 13, 1989

[30] Foreign Application Priority Data

Dec. 14, 1988 [JP] Japan ..... 63-313674

[51] Int. Cl.[5] ..... F02B 13/00

[52] U.S. Cl. ..... 123/580; 123/577

[58] Field of Search ..... 123/577, 580, 514, 437; 261/34.30, 34.2, 27

[56] References Cited

U.S. PATENT DOCUMENTS

| | | | |
|---|---|---|---|
| 4,076,770 | 2/1978 | Saito et al. | 261/34.3 |
| 4,179,245 | 12/1979 | Fuller | 261/34.3 |
| 4,424,676 | 1/1984 | Meiners | 123/577 |
| 4,518,540 | 5/1985 | Takayasu | 123/577 |

FOREIGN PATENT DOCUMENTS

| | | | |
|---|---|---|---|
| 2289750 | 5/1976 | Fed. Rep. of Germany | 261/34.3 |
| 239347 | 10/1988 | Japan | 261/34.3 |

OTHER PUBLICATIONS

Research Disclosure Apr. 1978 No. 16850.

*Primary Examiner*—E. Rollins Cross
*Attorney, Agent, or Firm*—Ernest A. Beutler

[57] ABSTRACT

A fuel increasing system for an internal combustion engine having a normal charge forming system with a plurality of carburetors. A supplemental fuel supplying system is incorporated that draws fuel from the fuel bowl of one of the carburetors to a supplemental fuel pump which, in turn, delivers fuel under pressure to a pressure regulating valve which regulates pressure by discharging excess fuel back to the fuel bowl from which it is drawn. The discharge of supplemental fuel to the engine is controlled by individual supplemental fuel control valves mounted on each of the carburetors.

9 Claims, 3 Drawing Sheets

FUEL INCREASING SYSTEM FOR ENGINE

BACKGROUND OF THE INVENTION

This invention relates to a fuel increasing system for an engine and more particularly an improved arrangement for providing supplemental fuel to an engine for certain running conditions.

It is well known to provide a charge forming system for an internal combustion engine that supplies a fuel-/air charge to the engine for its running. However, internal combustion engines are called upon to run over a wide variety of load and speed ranges. If the charge forming system is designed so as to provide the appropriate fuel/air ratio under all of these conditions it can become quite complicated.

It has, therefore, been proposed to provide a fuel supply system for an internal combustion engine that employs a main charge former that supplies fuel and air to the engine for its normal running conditions. However, there is provided a fuel increasing or supplemental fuel system for the engine so as to provide additional fuel under certain running conditions such as starting, cold warm up or acceleration. A wide variety of supplemental fuel supply systems have been proposed.

It has been found that the supplemental fuel supply system for an engine can be most effective if the fuel is supplied to the engine under the pressure of a separate fuel pump. By employing separate fuel pumps, it is not necessary to rely on the suction of the engine induction system to insure that the appropriate amount of supplemental fuel can be delivered. However, when an additional fuel pump is provided, the system can become quite complicated and, in some instances, it may be difficult to meet the desired ends.

For example, one application in which a supplemental fuel supply system is employed is in conjunction with an outboard motor. It is well known, however, that outboard motors frequently employ remotely positioned fuel tanks. If the supplemental system incorporates a supplemental fuel pump that draws separate fuel from the remotely positioned tank, the conduitry and connectors for connecting the remote system to the powerhead of the outboard motor can become quite complicated. In addition, it is the normal practice when supplemental fuel pumps are employed to incorporate a pressure regulator that regulates the pressure by returning excess fuel to the fuel system. If the excess fuel must be returned to a remotely positioned tank, the system obviously becomes more complicated.

Although alternative systems have been proposed wherein the supplemental fuel pump draws fuel from a conduit somewhere in proximity to the engine, for example from the fuel filter or some other place in the conduit upstream of the charge formers, then the pressure variations caused by the main fuel pump and the supply of two different fuel lines from a common source can give rise to variations in fuel supply by both the main and the supplemental system. Also, if the pressure is regulated by return of the excess pressure back into the line upstream of the charge former, for example in the fuel filter, air bubbles may be generated in the fuel return line which can be ingested into the fuel supply system of either the main or the auxiliary systems giving rise to additional problems.

It is, therefore, a principal object of this invention to provide an improved and simplified supplemental fuel system for an internal combustion engine.

It is a further object of this invention to provide an improved, simplified supplemental fuel system that will not require excess conduitry nor will it have the disadvantages aforenoted.

It is a further object of this invention to provide an improved, simplified supplemental fuel system for an outboard motor.

It is a further object of this invention to provide a supplemental fuel system embodying a pump and pressure regulator that can be mounted easily on a single component of the engine and thus permit easy applicability to outboard motors.

SUMMARY OF THE INVENTION

A first feature of this invention is adapted to be embodied in a fuel supply system for an internal combustion engine having a main fuel system comprising a fuel tank, a charge forming device for supplying fuel to the engine for its operation, and a main fuel pump for supplying fuel from the fuel tank to the charge forming device. The engine also includes a supplemental fuel supply system for supplying supplemental fuel to the engine for certain phases of its operation, which supplemental fuel system comprises a supplemental fuel pump for discharging fuel from the main fuel system. A supplemental fuel discharge is provided for delivering the supplemental fuel from the supplemental fuel pump to the engine and a pressure regulator is incorporated in the supplemental fuel discharge for bypassing fuel to a return to maintain a predetermined pressure in the supplemental fuel discharge. In accordance with this feature of the invention, the return from the pressure regulator communicates with the inlet of the supplemental fuel pump.

Another feature of the invention is adapted to be embodied in a charge former for delivering a fuel/air charge to an induction passage of an internal combustion engine. The charge former includes a fuel bowl in which fuel is maintained at a constant level by a float operated valve. In accordance with this feature of the invention, a supplemental fuel pump delivers fuel from the fuel bowl to the induction passage and a pressure regulator is positioned in the discharge from the supplemental fuel pump and bypasses fuel back to the fuel bowl to maintain a uniform head of pressure in the supplemental fuel discharge.

DETAILED DESCRIPTION OF THE PREFERRED EMBODIMENT OF THE INVENTION

Figure 1:
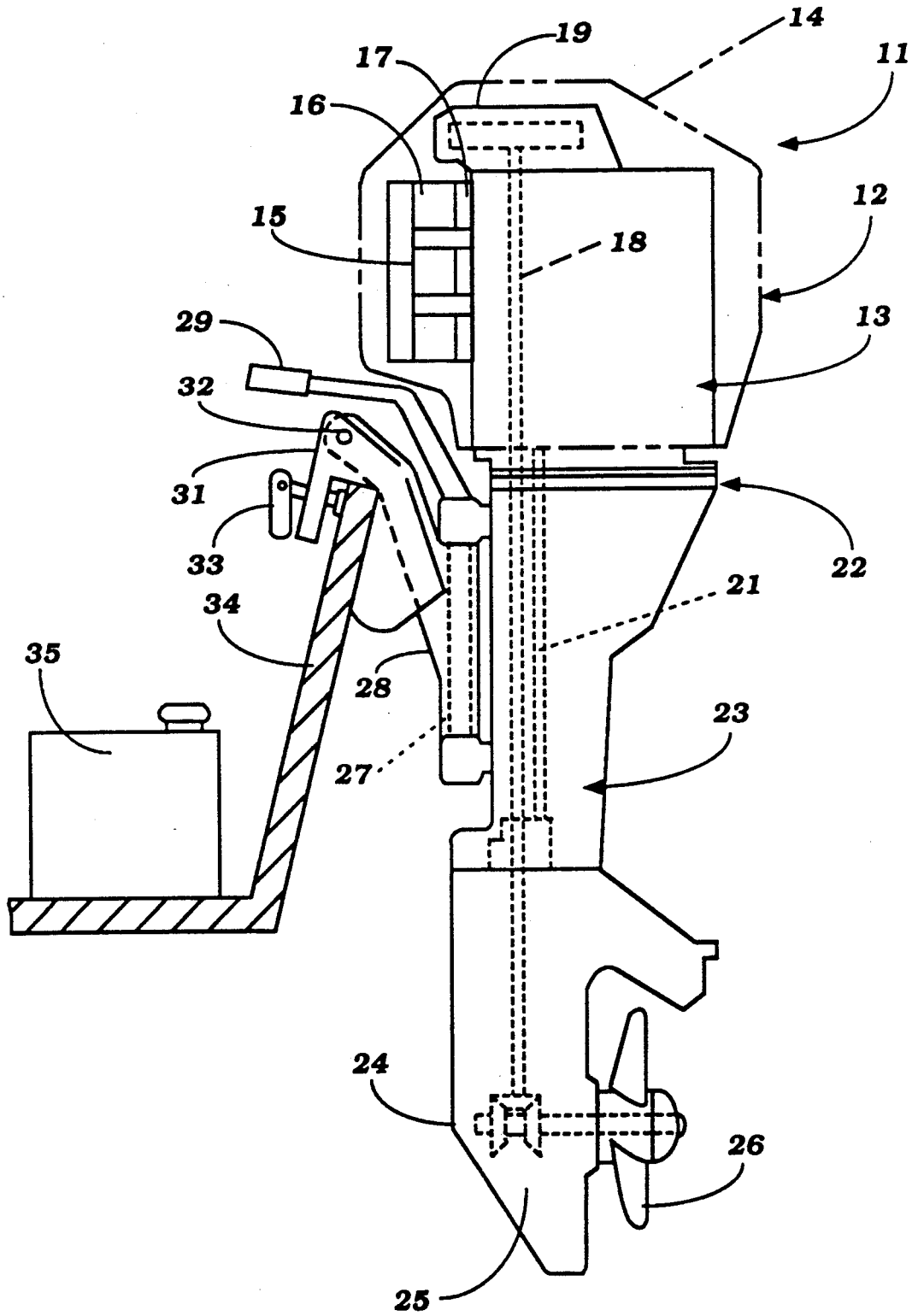
FIG. 1 is a side elevational view of an outboard motor having a fuel supply system constructed in accordance with an embodiment of the invention and attached to the transom of a watercraft which is shown partially and in section.

Referring in detail to the drawings and first to FIG. 1, an outboard motor embodying the invention is identified generally by the reference numeral 11. The invention is described in conjunction with an outboard motor although it is applicable to other types of applications for internal combustion engines. The invention, however, has particular utility in conjunction with outboard motors inasmuch as they normally employ remotely positioned fuel tanks that are connected to the internal combustion engine through removable quick disconnect connectors.

The outboard motor 11 includes a power head assembly, indicated generally by the reference numeral 12 which includes an internal combustion engine 13 and a surrounding protective cowling shown in phantom and identified by the reference numeral 14. The engine 13 may be of any known type but is depicted as being of the two cycle crankcase compression type and has a V-6 configuration. Of course, the engine has utility in conjunction with 4 cycle as well as two cycle engines as well as engines having other cylinder numbers or cylinder configurations and, in fact, rotary type engines.

As will become apparent, the engine 13 is provided with an induction system that includes an air inlet device 15, a plurality of carburetors 16 and intake manifold 17 that deliver a fuel/air charge from the carburetors 16 to the individual sealed crankcase chambers of the engine 13 as is typical with two cycle engine practice.

As is also conventional with outboard motor practice, the engine 13 is supported with its crankshaft 18 rotating about a vertically extending axis with a flywheel magneto assembly 19 affixed to the upper end of the crankshaft 18.

The crankshaft 18 drives a drive shaft 21 that depends from the powerhead 12 through a spacer plate assembly 22 which connects the power head 12 with a drive shaft housing assembly 23 and into the drive shaft housing 23. A lower unit 24 is carried at the lower end of the drive shaft housing 23 and there is positioned a forward, neutral, reverse transmission 25 that is driven from the drive shaft 21 in a known manner for selectively driving a propeller or other propulsion unit 26 in forward or reverse directions.

The outboard motor 11 also includes a steering shaft 27 that is affixed to the drive shaft housing 23 in an appropriate manner and which is journaled for steering movement of the outboard motor 11 about a vertically extending axis within a swivel bracket 28. A tiller 29 is affixed to the upper end of the steering shaft 27 for accomplishing this steering movement The swivel bracket 28 is, in turn, pivotally connected to a clamping bracket 31 by means of a pivot pin 32 for tilt and trim movement of the outboard motor 11 about a generally horizontally extending axis as defined by the pivot pin 32. A clamping device 33 is carried by the clamping bracket 31 for detachably affixing the outboard motor 11 to a transom 34 of an associated watercraft that is shown partially in FIG. 1. The construction of the outboard motor 11 and its attachment to the transom 37, as thus far described, may be considered to be conventional. For that reason, details of its construction are not believed to be necessary to understand the construction and operation of the invention.

Figure 2:
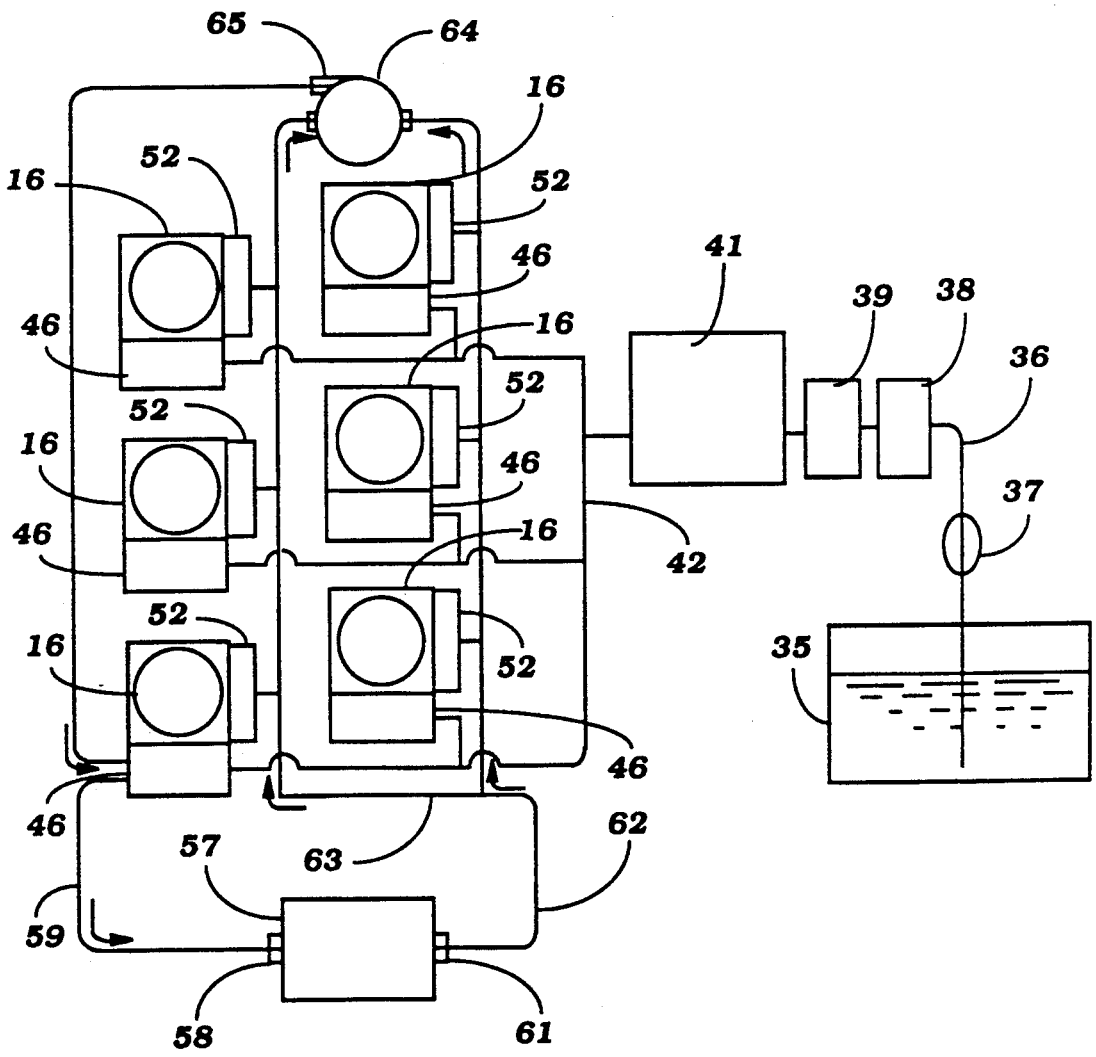
FIG. 2 is a schematic view of the fuel supply system.

As is conventional in outboard motor practice, a fuel tank 35 is positioned within the hull of the watercraft and supplies fuel to the engine 13 for its operation. The fuel supply system for the engine embodies the invention and is shown schematically in FIG. 2. A conduit 36 extends from the fuel tank 35 across the transom 34 to the power head 12 of the outboard motor 11. A detachable connection may be provided somewhere in the conduit 36 so as to permit removal of the fuel tank 35 for refilling and also so as to permit the outboard motor 11 to be detached from the transom 34 without removal of the fuel tank. A manual priming pump 37 is provided in the conduit 36 on the transom side of this detachable connection.

Also positioned in the conduit 36 but normally contained within the powerhead 12 is a one way check valve 38 which will preclude gasoline from draining out of the engine 13 when the connection is broken. Also, provided in the power head 12 and normally mounted on the engine 13 is a fuel filter 39 and engine driven main fuel pump 41. A fuel manifold assembly 42 supplies fuel to the individual carburetors 16.

Figure 3:
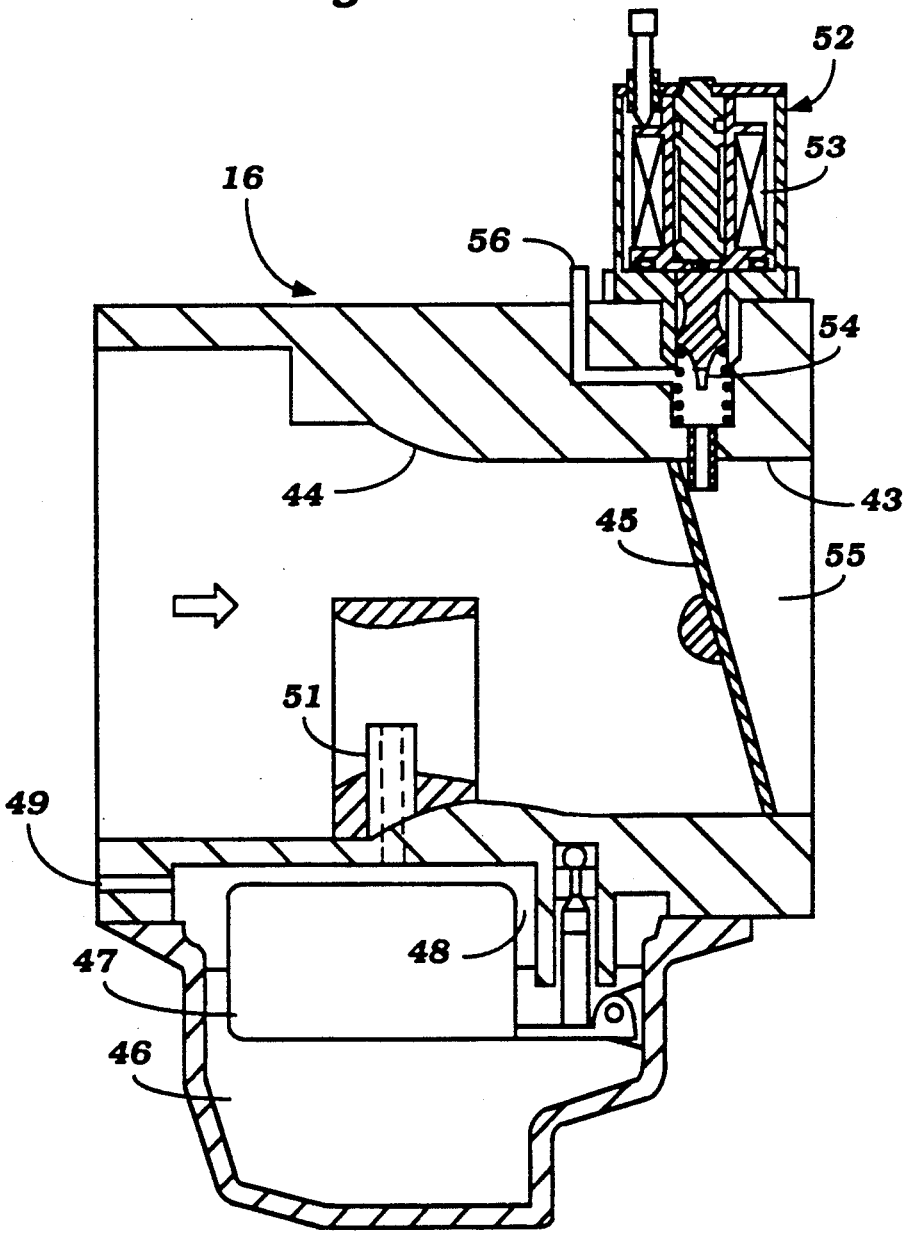
FIG. 3 is a cross-sectional view taken through one of the carburetors of the engine.

As may be best seen in FIG. 3, each carburetor 16 includes a main body assembly that includes an induction passage 43 which includes a venturi section 44. A manually operated throttle valve 45 is positioned in the induction passage 43 downstream of the venturi section 44 for controlling the air flow and engine speed.

The fuel from the manifold 42 is delivered to a float bowl 46 of the carburetor 16 in which a float 47 is provided for operating a needle valve assembly 48 so as to maintain a uniform level of fuel in the fuel bowl 46. An atmospheric vent 49 extends to the atmosphere above the normal level of fuel in the fuel bowl 46 for venting the fuel bowl and insuring a uniform level of fuel therein.

The carburetor 16 is also provided with idle, transition and main fuel discharge systems which may be considered to be conventional. Only the main fuel discharge nozzle 51, which is positioned at the venturi section 44, is depicted since these components may be of any conventional type.

The fuel delivery system as thus far described may be considered to be conventional However, in accordance with the invention, a supplemental or additional fuel supply system is incorporated for supplying supplemental fuel to the engine under certain running conditions. This supplemental fuel system includes a supplemental fuel control valve 52 that is mounted on each of the carburetors 16 and which is shown in most detail in FIG. 3. This supplemental fuel control valve 52 includes a solenoid winding 53 that operates a needle type valve 54 so as to control the discharge of supplemental fuel into the induction passage 43 downstream of the throttle valve 46 through a supplemental fuel discharge nozzle 55. Fuel is supplied to the supplemental fuel control valve 52 through a fuel supply port 56 in a manner which will be described. The way the device operates is that the time of energization of the solenoid valve 53 is varied so as to control the amount of supplemental fuel discharge through the discharge nozzle 55 in response to such engine conditions as cold starting, cold running or acceleration. Supplemental fuel may be provided for any of the other known purposes.

Supplemental fuel is delivered to the supplemental fuel ports 56 of the supplemental fuel control valves 52 from a system that includes a supplemental fuel delivery pump 57 (FIG. 2) which may be driven in any known manner, for example, by fluctuations in pressure in the crankcase chambers of the engine or mechanically. Fuel is delivered to an inlet port 58 of the supplemental fuel pump 57 from the float bowl 46 of one of the carburetors 16 through a delivery conduit 59. The fuel pressurized by the supplemental fuel pump 57 is delivered through a discharge port 61 to a conduit 62. The conduit 62 discharges to a fuel manifold 63 that communicates with the inlet ports 56 of the supplemental enrichment valves 52.

A pressure regulating valve 64 is provided in the manifold 63 for maintaining a uniform pressure at the enrichment valve delivery ports 56. The pressure regulating valve 64 is of the type that maintains uniform pressure by bypassing excess fluid back through a return port 65 to the fuel supply system. In accordance with the invention, the return fuel is delivered to the fuel bowl 46 of the carburetor 16 from which the fuel was taken for the supplemental fuel delivery pump 57. In this way, any air bubbles which may be entrapped in the fuel that is returned from the return port 65 can escape through the air vent 49 of the respective fuel bowl 46 and will not reenter either the main or additional fuel supply circuits.

It should be readily apparent from the foregoing description that the described fuel system is extremely compact, avoids the necessity of remote conduits that go back to the remotely positioned fuel tank 35 and can, for the most part, all be mounted on one of the carburetors 16 of the engine 13. Although an embodiment of the invention has been illustrated and described, various changes and modifications may be made without departing from the spirit and scope of the invention, as defined by the appended claims.

We claim:

1. A fuel supply system for an internal combustion engine having a main fuel system comprising a fuel tank, a charge forming device for supplying fuel to said engine for its operation and a main fuel pump for supplying fuel from said fuel tank to said charge forming device and a supplemental fuel system for supplying supplemental fuel to said engine for certain phases of its operation comprising a supplemental fuel pump for drawing fuel from said main fuel system, a supplemental fuel discharge for discharging supplemental fuel from said supplemental fuel pump to said engine and a pressure regulator in said supplemental fuel discharge for bypassing fuel to a return for maintaining a predetermined pressure in said supplemental fuel discharge, the improvement comprising said return communicating with the inlet of said supplemental fuel pump.

2. A fuel supply system as set forth in claim 1 wherein the charge forming device includes a fuel bowl in which fuel is maintained at a constant level and wherein the supplemental fuel pump draws fuel from said fuel bowl.

3. A fuel supply system as set forth in claim 2 wherein the return delivers excess fuel back to the fuel bowl.

4. A fuel supply system as set forth in claim 3 wherein the charge forming device comprises a carburetor and wherein there is further provided a supplemental fuel control valve mounted on the carburetor for delivering supplemental fuel to the engine.

5. A fuel supply system as set forth in claim 4 wherein the engine is provided with a plurality of carburetors and wherein the supplemental fuel is drawn from and returned to the fuel bowl of only one of the carburetors.

6. A fuel supply system as set forth in claim 1 further including a supplemental fuel control valve in the supplemental fuel discharge for controlling the discharge of supplemental fuel to the engine.

7. A fuel supply system as set forth in claim 6 wherein the supplemental fuel control valve is mounted on a component of the fuel supply system that communicates with the inlet of the supplemental fuel pump.

8. A charge former for an internal combustion engine having a fuel bowl, float operated valve means for maintaining a uniform head of fuel in said fuel bowl, discharge circuit means for discharging fuel from said fuel bowl into an induction passage formed by said charge former, the improvement comprising a supplemental fuel pump for drawing fuel from said fuel bowl and discharging it to said induction passage, a pressure regulator positioned in the discharge of said supplemental fuel pump for bypassing fuel back to said fuel bowl to maintain a uniform head of pressure in said supplemental fuel pump.

9. A charge former as set forth in claim 8 further including a flow control valve mounted on said charge former and communicating with said induction passage for delivering fuel from said supplemental fuel pump selectively to said induction passage.

* * * * *